US005951048A

United States Patent [19]

Slaughter

[11] Patent Number: 5,951,048

[45] Date of Patent: Sep. 14, 1999

[54] AFFIRMATIVE HOIST LEASH ARRANGEMENT

[76] Inventor: James E. Slaughter, 1911 1/2 Warfield Ave., Redondo Beach, Calif. 90278

[21] Appl. No.: 08/807,254

[22] Filed: Jul. 16, 1996

Related U.S. Application Data

[63] Continuation-in-part of application No. 08/435,853, May 5, 1995, abandoned.

[51] Int. Cl.[6] ..... A63C 11/00

[52] U.S. Cl. ..... 280/814; 280/637

[58] Field of Search ..... 280/807, 814, 280/816, 819, 826, 637, 14.2; 441/70, 75

[56] References Cited

U.S. PATENT DOCUMENTS

| | | | |
|---|---|---|---|
| 3,931,656 | 1/1976 | Thomson | 280/637 |
| 4,013,318 | 3/1977 | Piper | 280/809 |
| 4,044,415 | 8/1977 | Wood | 441/75 |
| 4,556,252 | 12/1985 | Serex | 280/809 |
| 4,929,208 | 5/1990 | Corica | 441/75 |
| 4,940,255 | 7/1990 | Donine | 280/809 |
| 5,194,026 | 3/1993 | Corwin et al. | 280/637 |
| 5,564,729 | 10/1996 | Gomex et al. | 280/637 |
| 5,653,467 | 8/1997 | Griffin et al. | 280/809 |
| 5,697,631 | 12/1997 | Ratzek et al. | 280/14.2 |

*Primary Examiner*—Christopher P. Ellis
*Assistant Examiner*—Frank Vanaman
*Attorney, Agent, or Firm*—John E. Halamka

[57] ABSTRACT

A leash arrangement attachable to the binding of a snow gliding device or directly to the device and having a leash tube extending up along the user's leg with a strap at the top to hold the leash tube at a position accessible to the user. A shock cord is threaded inside the leash tube. One end of the shock cord is attached to the binding or device and the other end has a handle which may be mounted by a snap to the leg strap. Upon sitting on a lift chair, the user pulls on the handle thereby elongating the shock cord. The handle is then placed under the thigh of the user to provide affirmative hoisting of the snow gliding device during the chair lift ride. If the user is wearing ridged high top boots, the leash tube may be eliminated and a hasp eye mounted on the leg strap as a guide for the shock cord. A folded deployable edge guard may be mounted on the shock cord between the hasp eye and the handle which rests under the shock cord as it engages the edge of the seat on the chair lift. A simple straw shaped tube may be used for the leash tube.

12 Claims, 6 Drawing Sheets

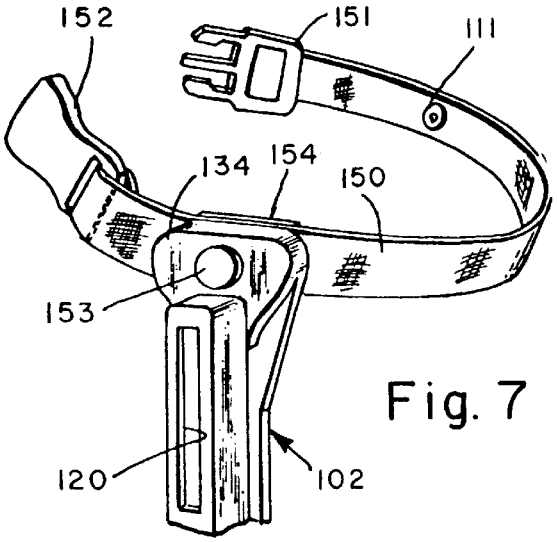
Fig. 7
Fig. 4.
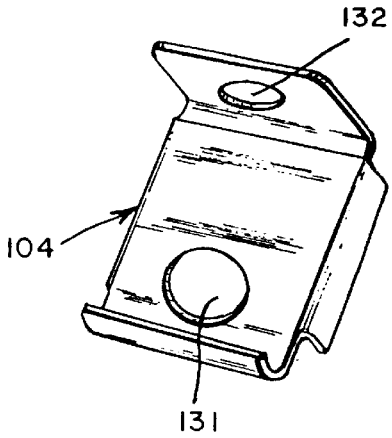
Fig. 5.
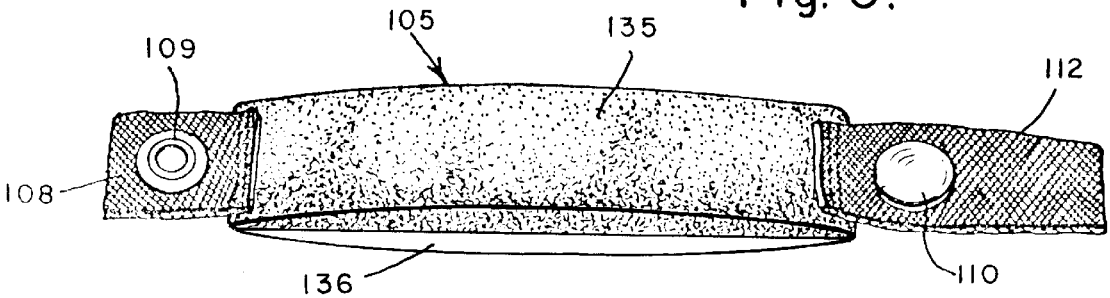
Fig. 6.
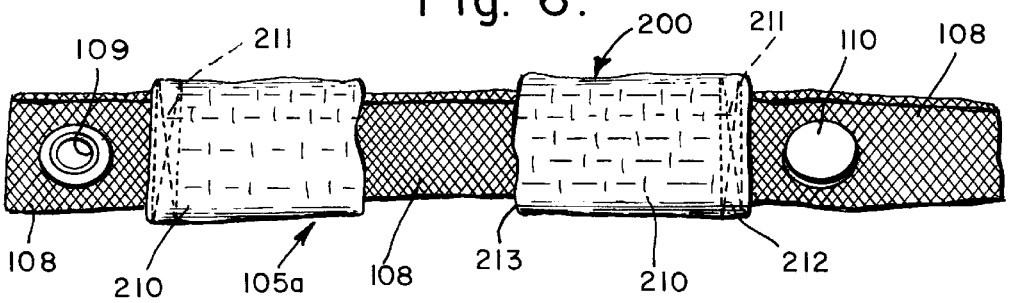

AFFIRMATIVE HOIST LEASH ARRANGEMENT

This application is a continuation-in-part of patent application Ser. No. 08/435,853, filed May 5, 1995, now abandoned.

FIELD OF THE INVENTION

This invention relates to the field of sports safety and support equipment and more particularly to the leashing of equipment to the user during the sport of gliding on snow, said leash also providing an affirmative hoisting of the equipment particularly during the ride on an open chair ski lift.

DESCRIPTION OF THE PRIOR ART

The proprietors of ski facilities have required the secure attachment of snow gliding items such as skis and snow boards to the user before allowing the user to board a ski lift, particularly lifts in which the user sits with the skis or snow board still attached to the user's boot. A leash arrangement may also be required by the proprietors for the user to descend the slope.

Prior solutions have produced leash arrangements which consist of a length of webbing sometimes attached to a strap. The webbing may have one end tied to the binding mounted on the gliding device and the other end tied around the leg of the user. If a strap was supplied at the end of the webbing, the strap would be tightened around the user's calf muscle. Such arrangements were cumbersome, unsafe and generally would slip down the leg of the user to a position which may even interfere with the function of the equipment.

Even if the gliding device is detached from the user's boots and carried aboard the lift, the user may still drop the device while riding on the lift.

Past solutions have only conformed to the safety requirements of securely attaching the gliding device to the user.

Of particularly concern to the user of a snow board fixed in a sitting position during the journey on an open chair lift is the weight of the snow board attached to only one foot. This alone can place a strain on that foot which causes the user to be uncomfortable or even render the one leg temporally non-functional. Additionally, the natural tendency is for the user to rest the foot which is unattached on the foot attached to the snowboard. This increases the strain on the attached leg. With one leg exhausted, the enjoyment of a day of snowboarding consisting of many runs up a ski lift may be severely shortened.

The other tendency to place the attached board on the unattached foot results in cut boots, twisted knee syndrome, and/or numbness (with resultant lack of warmth and control) all without relief of symptoms or solution of the problem.

Thus there has long been a need for an arrangement which meets the requirements of the proprietors of ski lifts for safely attaching the gliding device to the user but also allows the user to arrive at the destination in comfort without any strain on the leg to which the device is attached.

It is desired that the affirmative hoist device allow the gliding device to be securely attached to the user as required by safety guidelines.

It is further desired that the affirmative hoist device be readily removably attachable to the user.

It is further desired that the affirmative hoist device compensate for at least the weight of the gliding device as well as the weight of the affirmative hoist device so that the user perceives relatively equal downward force on both legs while riding on a lift.

It is further desirable that the upward force generated by the affirmative hoist device be easily engagable and disengagable without compromise to the user's safety. The user should not have to lean forward or reach far, especially while seated, to engage the lifting function of the device.

It is further desired that once engaged, the device automatically disengage by the simple method of having the user rise off of the lift.

SUMMARY OF THE INVENTION

Accordingly, it is an object of the present invention to provide an affirmative hoist device which is easy to attach or remove from the user yet complies with the safety requirements of ski lift proprietors for attachment of the gliding device to the user.

It is another object to provide an affirmative hoist device which will generate sufficient force to compensate for at least the combined weight of the gliding device, a boot and the affirmative hoist device.

It is yet another object to provide a safe and easily accessible engagement of the affirmative hoist device without the assistance of others after the user is situated on the lift.

The above and other objects of the present invention are achieved, according to a preferred embodiment thereof, by providing a leash arrangement with affirmative hoist.

In the preferred embodiment, the application of an elastic shock cord threaded though a semirigid leash tube and a friction grip pad/handle mounted on the end of the elastic shock cord at a point easily accessible to the user, allows the user to grab and pull on the handle to intensify the affirmative hoist and then sit on the friction grip pad/handle to maintain the affirmative hoist during the journey. When the user rises above the seat, the friction grip pad/handle will immediately disengage the affirmative hoist function. The shock cord will contract bringing the pad/handle to a position which will not interfere with the egress of the user from the lift.

The semirigid leash tube prevents the device from collapsing around the ankle of the user and becoming unsafe to reach no matter how strenuous the run.

Another embodiment without the semirigid leash tube may be utilized by persons wearing high top boots which provide a ridged top surface which may be available to support the leg strap. Some boots used for snow boarding utilize a construction having an external hard shell. The strap for this embodiment is attached to the leg of the user above this hard shell. Hence, the leash tube may be eliminated as the strap cannot slip below the top of the boot. However, even traditional leather type boots are rigid enough to support the leg strap above the top of the boot.

Alternative attachment of the leash directly to the snow board rather than to the binding is possible for each embodiment which eliminates the risk of loss of the board should the binding becoming separated from the board.

Another section of webbing may be included in each embodiment. The webbing is accordion folded onto the shock cord and deployed upon stretching the shock cord. When deployed this webbing performs the function of a chair edge guard for the shock cord to reduce the wearing of the shock cord during repeated deployment over the edge of the chair lift and movement against the edge of the chair during the ride.

BRIEF DESCRIPTION OF THE DRAWINGS

The above and other embodiments of the present invention may be more fully understood from the following detailed description, taken together with the accompanying drawings, wherein similar reference characters refer to similar elements throughout, and in which:

FIG. 4 is a perspective view of the end plate;

FIG. 5 is a perspective view of the friction grip pad/handle;

FIG. 6 is a perspective view of another embodiment of the friction grip pad/handle;

FIG. 7 is a perspective view of another embodiment of the leash arrangement;

DESCRIPTION OF A PREFERRED EMBODIMENT

Figure 1:
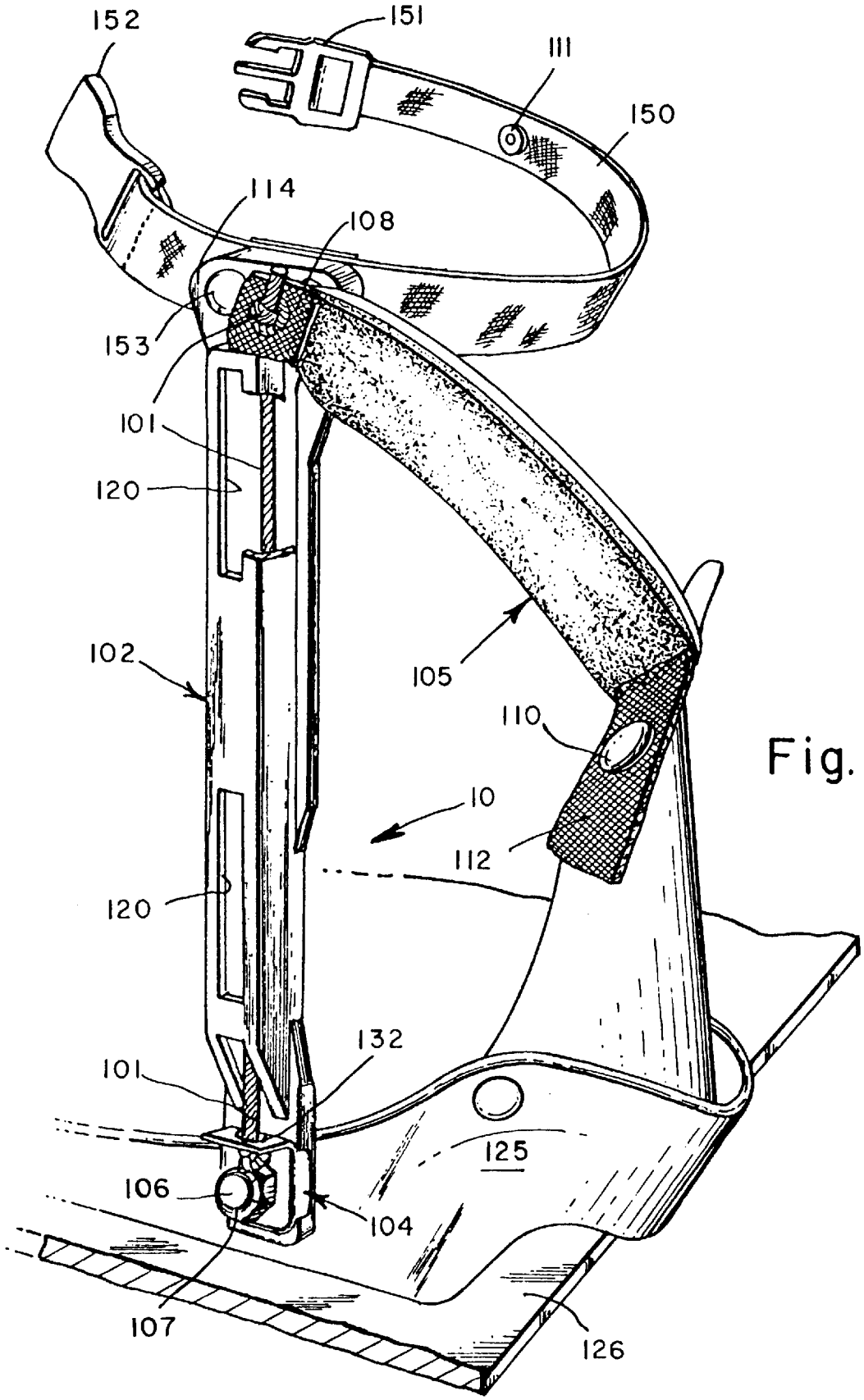
FIG. 1 is a perspective view of the leash arrangement.

Referring now to the drawings, FIG. 1 shows the affirmative hoist device, generally designated 10, according to the invention.

A semirigid leash tube 102 is unitarily fabricated of semi-flexible material preselected to be tolerant of low temperature. The material should also have good sheer strength and be abrasion resistive. A thermoplastic polyurethane elastomer available from DOW as 2103 Pellethane is used in the preferred embodiment herein.

Figure 2:
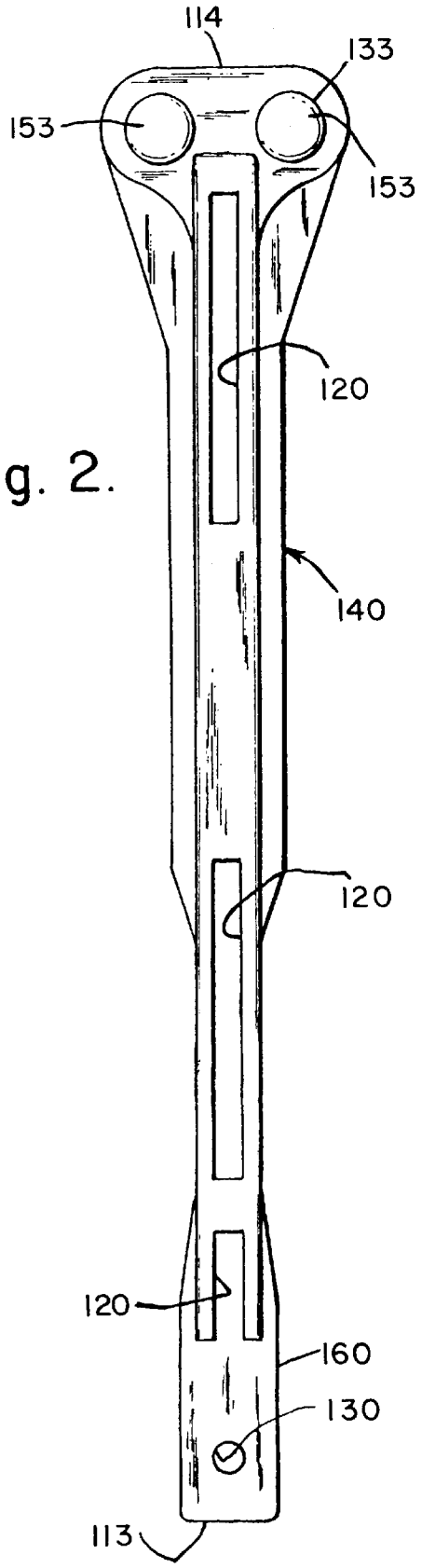
FIG. 2 is a front plane view of the semirigid leash tube.
Figure 3:
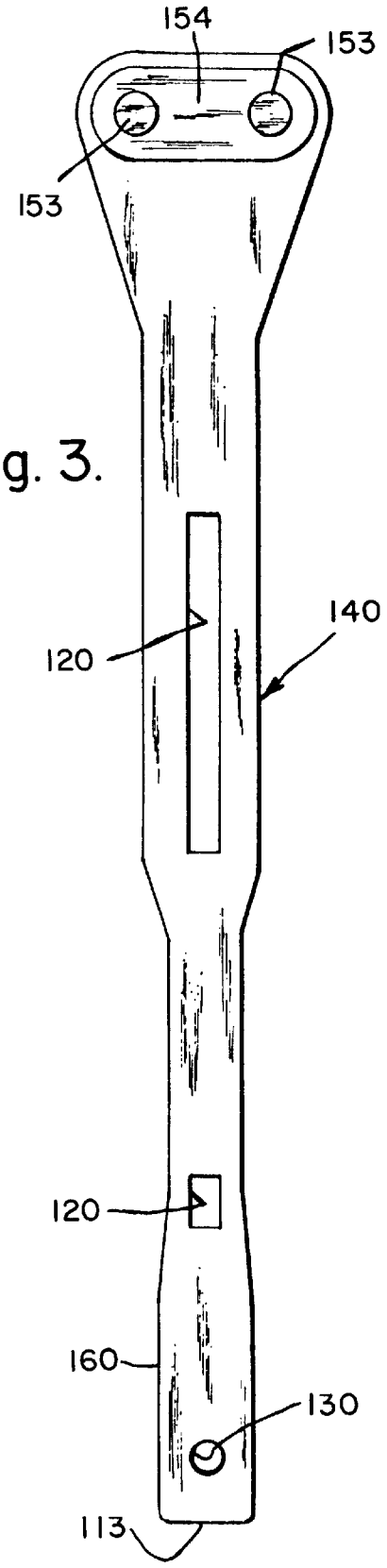
FIG. 3 is a rear plane view of the semirigid leash tube.

FIGS. 2 and 3 illustrate the use of a generally square cross section leash tube 102, molded with selectively spaced channels 120 in the front and back to form a semirigid leash tube 102 through which the elastic shock cord 101 may be threaded. A round cross section for the leash tube 102 may be too flexible and allow the device 10 to collapse around the user's ankle.

The length of the leash tube 102 is selected to allow the user to comfortably lean only slightly forward in the lift chair or slightly raise the leg to which the device 10 is attached before being able to reach the friction grip pad/handle 105 without any concern or the slightest sensation of falling forward out of the lift chair.

First wall 130 forms a mounting hole in the distal end 113 of the tube 102.

A flat flange 140 is integrated into the design of the leash tube 102 to supply an additional plane of stiffness.

FIG. 4 illustrates an end plate 104 fabricated of sheet metal to overlay a selected portion of the distal end 113. Second wall 131 forms a hole which is in alignment with the mounting hole formed by first wall 130. The end plate 104 takes the load of the elastic shock cord 101 off the leash tube 102 and allows direct coupling of the load to the binding 125.

Third wall 132 forms a mount for the elastic shock cord 101. The lower end 103 is threaded through the mount 132 and a simple knot is tied in the end 103.

Figure 8:
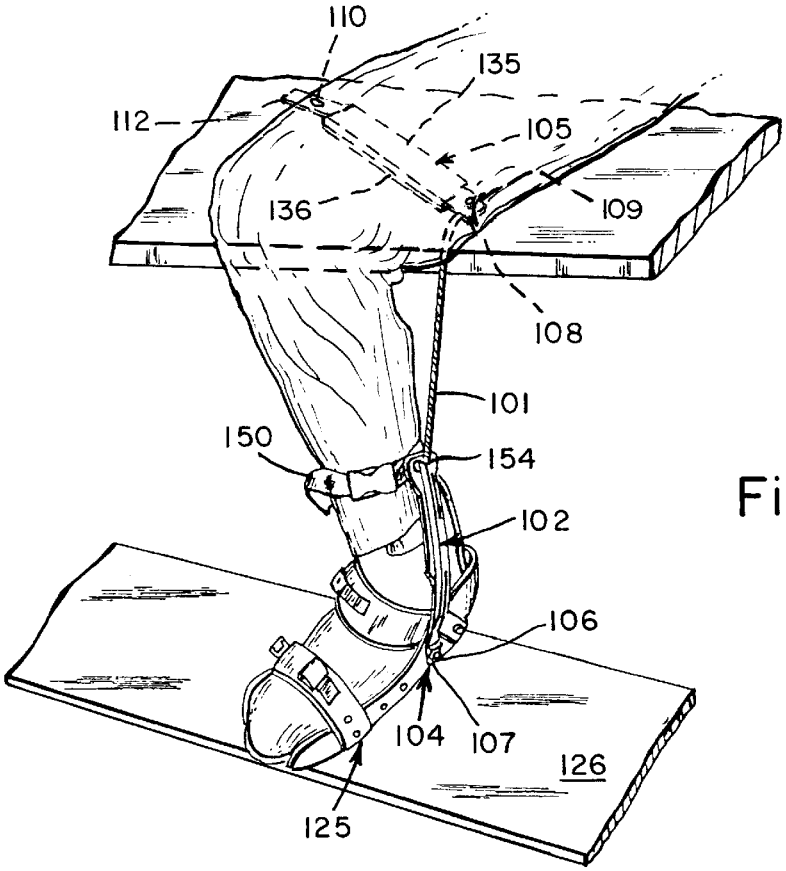
FIG. 8 is a perspective view of the deployed leash arrangement.

The affirmative hoist 10 is attached to the binding 125 of the snow gliding device 126 by installing a ¼ inch bolt in the performed hole designated for leash mounting or by drilling a ¼ inch bolt hole at a preselected position in the binding, generally centered at least approximately ⅜ of an inch above the upper surface of the snow gliding device 126. As illustrated in FIGS. 1 and 8, a bolt 106 is mounted through this ¼ inch hole and engaged through first wall 130 and second wall 131. A self-locking nut 107 is engaged on the bolt 106 to secure the end plate 104 and distal end 113 of the hoist 10 to the binding 125 yet loose enough to allow rotation of the distal end 113 around the bolt 106. This allowable movement prevents the sheer stresses of use of the hoist 10 from fatiguing the distal end 113 into separation failure as well as rotation during the flexing of the user's lower leg relative to the snow board.

Additional freedom of movement and flexibility is allowed by the formation of a hinge area 160 between first wall 130 and the lower end of the leash tube 102.

It is important to note that the lower end of the elastic shock cord 103 is in direct communication with the binding 125 and all loads from the shock cord 101 bypass the leash tube 102.

Friction grip pads 105 are mounted on a web spline 108 to form a friction grip/handle. The web spline 108 extends beyond the ends of the friction grip pads 105 to allow the mounting of a grommet 109 on one end and a snap 110 on the other end which is folded and stitched to form a tab 112 easily engagable by the user to pull, disengage the snap 110 from the snap catch 111 and grab the friction grip/handle 105. The extended end of the web spline 108 is fabricated of close weave nylon to avoid the grommet 109 or snap 110 from pulling loose.

After being threaded through the leash tube 102, the upper end of the elastic shock cord 101 is threaded through grommet 109 and the end tied in a knot as above. The elastic shock cord 101 is selected to have an elongation of 100 to 110% rather than an elongation of approximately 125%. The material lining the outside surface of the shock cord is selected to be smooth to avoid chafing as the shock cord is pulled out of and retracted into the leash tube 102. The upper end of the leash tube 102 may be rounded to further prevent chaffing of the elastic shock cord 101. The shock cord 101 may be entirely encased within a nylon webbing or tube to maintain the "leash" component of the device even though the shock cord 101 has a catastrophic failure and separates. Of course, in this embodiment, the leash tube 102 continues to attach the board to the user.

Referring to FIG. 2, the top end 114 of the leash tube 102 is formed as a mounting bracket, fourth walls 133 forming mounting holes therein. The mounting holes may be formed in stages to form a counter sink recess for the head of a rivet.

As shown in FIG. 1, a leg strap 150 is attached to the top end 114 of the leash tube 102 with two rivets. A rivet plate 154 may be used to assist in relieving any strain on the leg strap 150. A snap catch 111 is mounted on the leg strap 150 in a position selected to maintain the pad/handle 105 in a position accessible to the user.

Catch 151 and latch 152, preferably fabricated of a polypropylene or acrylic material to be chip resistant and flexible at cold ambient conditions, are mounted to the ends of the leg strap 150. These snap together and squeeze for quick release connectors are readily available at camping or mountaineering equipment suppliers.

The pad/handle 105 is shown to be formed directly onto and around the web spline 108 for strength and durability.

FIG. 1 shows the configuration and attachment of the leg strap 150 to the leash tube 102 for use by a person who rides the board with their right foot forward. For a person who rides the board with their left foot forward, the attachment of the leg strap 150 would be in the other direction.

FIG. 7 illustrates an embodiment of the invention herein fabricated as taught above except this embodiment utilizes only one rivet 153 to attach the leg strap 150 to the leash tube 102. The rivet plate 154 in this embodiment may be a washer fabricated of metal with a compliant material such as polytetrafluoroethylene or some other material between the washer and the webbing of the polypropylene leg strap 150 which will allow rotation of the leg strap 150 around the single rivet 153. With the single rivet 153, the device 10 may be used by either predominantly right footed or left footed persons with a simple rotation of the leg strap 150.

FIG. 5 illustrates an embodiment of the friction grip pad/handle 105 wherein the web spline 108 is attached to one end of the pad/handle 105 and the snap tab 112 is attached to the other end of the pad/handle 105. The pad/handle being fabricated of a top portion 135 and a bottom portion 136.

FIG. 6 illustrates an embodiment of the friction grip pad/handle 105*a* which may be fabricated with layers formed of neoprene with nylon fabric surface 210 similar to the material used in wet suits. One layer may be coated with a slippery nylon fabric 200 and the other pad coated with a nylon fabric 210 which maintains a rubberized or sticky texture. This rubberized texture has increased friction and configured to be placed on bottom side of the friction grip pad/handle 105*a* to aid in keeping pad 105*a* in place when placed under the leg of the user while the user is seated in the lift chair. The other nylon coating 200 will form a slippery surface on top of the pad 105*a* to allow leg of the user to move above pad to adjust the comfort of the user without releasing the sticky friction grip/handle 105*a*.

A section of elastic tape 211 is attached with expandable stitching 212 to each short end edge of each layer 210/211 while both the layer and the elastic tape 211 are being stretched. The elastic tape 211 strengthens the edges and aids in preventing unraveling. The two layers are placed elastic tape 211 side together and stitched together along each long side. The combination is then turned inside out while pulling the web spline 108 and a pad 213 between the layers. A piece of neoprene foam is then inserted inside the resulting "channel" between layers 210 and 211. This additional foam results in additional thickness to the pad. The short ends are again stitched together which attaches the layers to the web spline 108 with the pad 213 enclosed between the layers.

Figure 9:
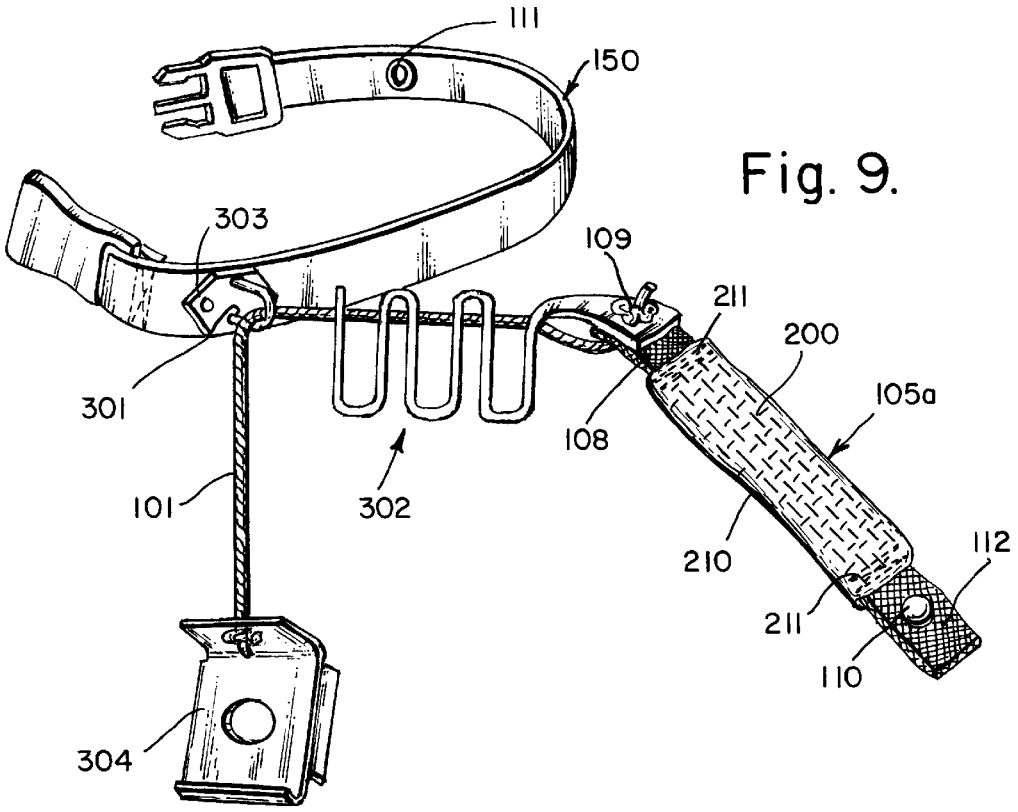
FIG. 9 is a perspective view of another embodiment of the leash arrangement.

FIG. 9 illustrates an embodiment, generally designated 300, of the leash device which does not require a semirigid tube as a guide for the shock cord. This embodiment can be utilized with high top snow boarding boots which incorporate a stiff outer shell. Because the leg strap 150 is attached to the user's leg above the boot, the tube taught above which prevented the strap 150 from riding down to the ankle can be eliminated.

With the elimination of the semirigid tube a hasp eye 301 is attached to the strap 150 by large head rivets 303 as the guide of the shock cord 101. In the preferred configuration, the diameter of the shock cord 101 is increased to ¼" as a safety factor. With the elimination of the leash tube, only the shock cord 101 attaches the board to the user.

The pad/handle, generally designated 105*a,* is similar to that more fully illustrated in FIG. 6.

One end of the shock cord 101 is attached to the board with a board mount end plate 304, generally "U" shaped with one end bolted directly to the board. The other end serves as an anchor point for one end of the shock cord 101. The other end of the shock cord 101 is routed through the hasp eye 301 attached to the leg strap 150 by rivets 303. The edge guard (see below) is generally designated 302, and the pad grommet 109. The grommet 109 may be fabricated of nylon to protect the shock cord 101 from wear as it is configured in approximately a 90 degree angle.

Figure 11:
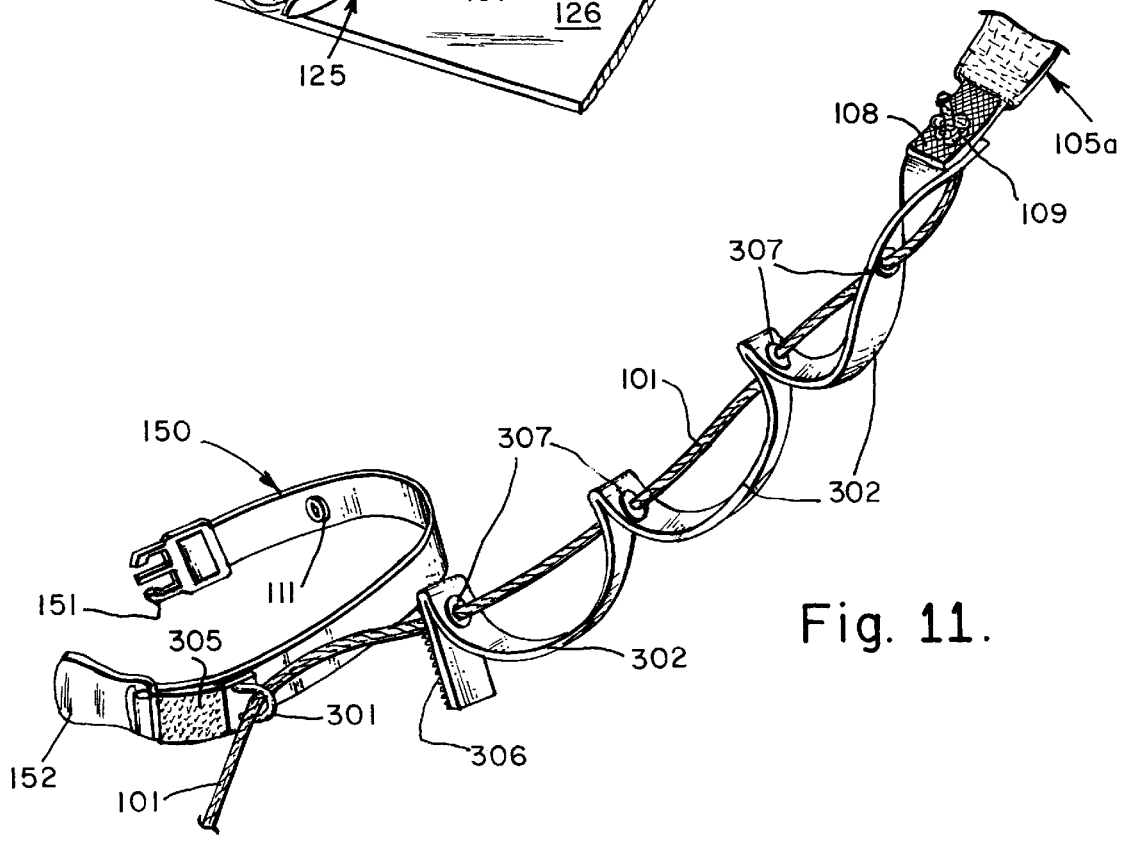
FIG. 11 is a perspective view of the edge guard.
Figure 10:
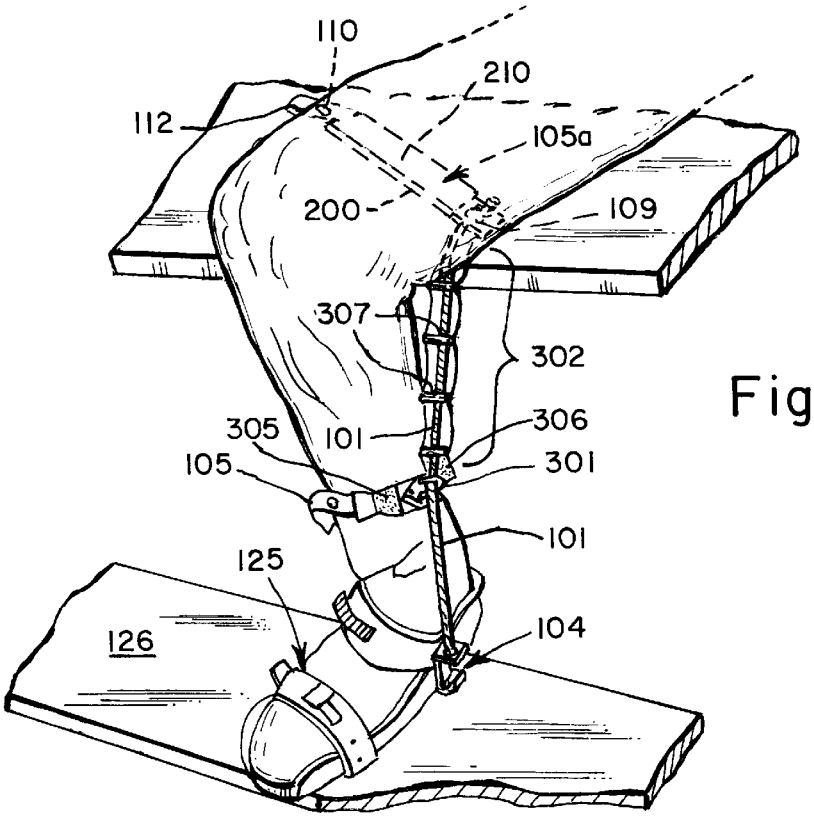
FIG. 10 is a perspective view of the deployed leash arrangement.

FIG. 10 illustrates the edge guard 302 in a deployed configuration. FIG. 11 illustrates the edge guard 302 in detail. The edge guard 302 is fabricated of webbing material which has a plurality of folds. An opening which may be protected by a grommet 307 is formed in the webbing material near each fold. One end of the edge guard 302 is attached to the web spline 108 whereby the edge guard 302 is deployed upon the user engaging the pad/handle 105*a* and pulling the shock cord 101 to the extended position. The length of the edge guard 302 may be shorter than the shock cord 101. In order to eliminate binding, the end of the edge guard 302 may be attached to the leg strap 150 with a hook and loop fastener 305/306 which disengages upon deployment and re-engages upon attachment of the pad/handle 105*a* to the leg strap 150. One side of the edge guard 302 may be coated to provide a non-slippery surface to enhance the deployment of the device.

Safety and durability considerations may result in use of a shock cord 101 with a diameter of 3/16 inches in this embodiment.

Each of the above embodiments may use the direct board mounting 304 rather than attachment to the binding 125.

Figure 12:
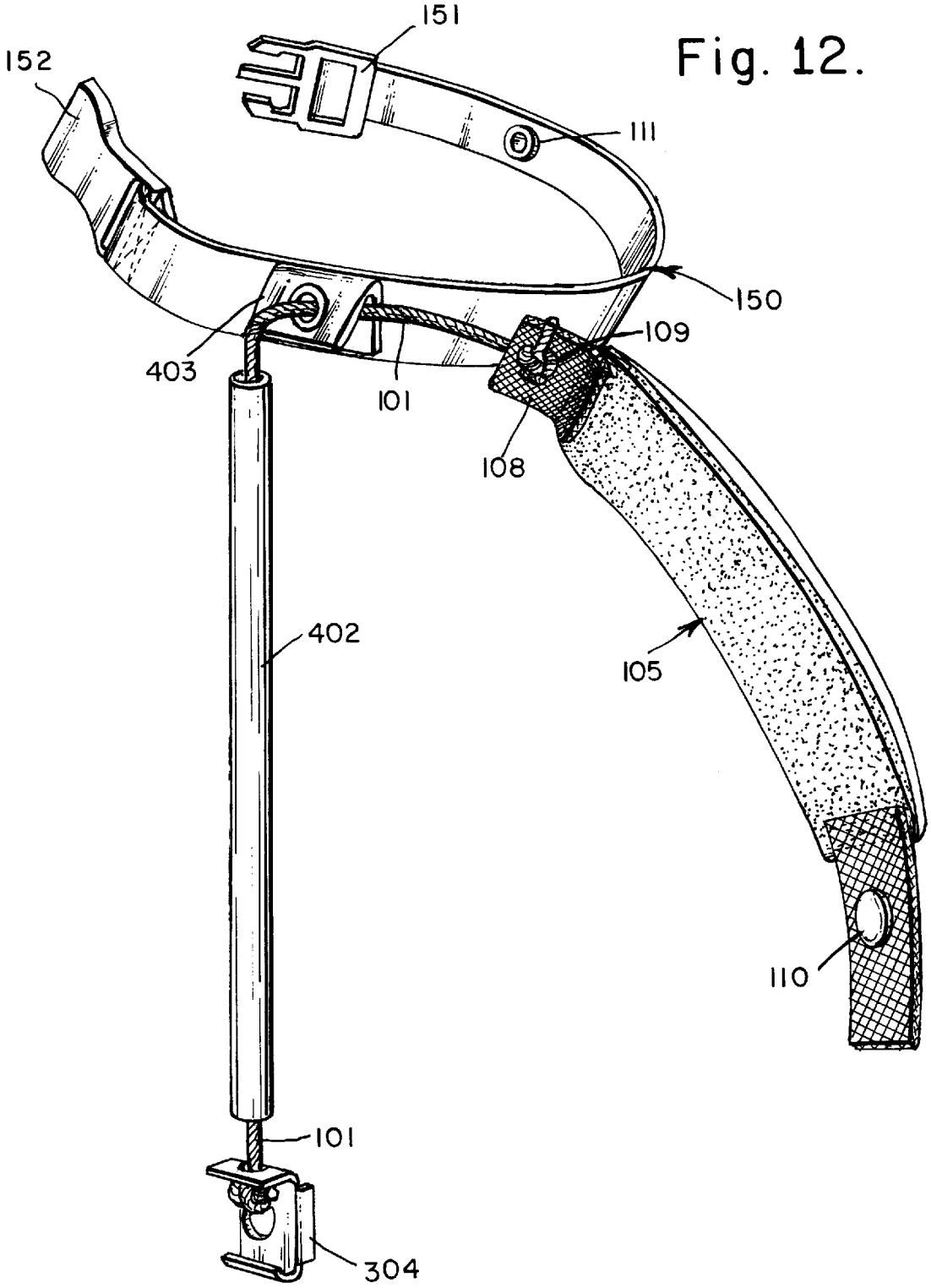
FIG. 12 is a perspective view of another embodiment of the leash arrangement.

The semirigid support configuration 102 may be replaced by a tube which resembles a soda straw support 402, shown in FIG. 12. The tube support 402 derives its semirigid state because of the round shape and the material from which it is fabricated. The leash tube 102 described above had a stronger semirigid state from the square design with ribbing and flanges. The shock cord 101 is routed through the tube support 402. One end of the shock cord 101 is tied to be engaged with a board mount end plate 304. The hasp eye 301 described above may be replaced by a guide tab 403 mounted on the leg strap 150. The guide tab 403 may be reinforced by a grommet 409 as taught above. The other end of the shock cord is threaded through the grommet 109 of the guide tab and through the grommet 109 of the pad/handle 105. The guide tab 403 performs a function similar to the hasp eye 301 set forth above.

Since certain changes may be made in the above apparatus without departing from the scope of the invention herein involved, it is intended that all matter contained in the above description, as shown in the accompanying drawings, shall be interpreted in an illustrative, and not a limiting sense.

What is claimed is:

1. An improved leash arrangement for a snow gliding device having a binding mounted thereon whereby a user wearing foot coverings may engage at least one of said foot coverings into said binding, may connect one end of said leash arrangement to said binding, thereafter said leash arrangement is adapted for use on a chair lift having a seat with a front edge, said leash arrangement providing affirmative hoisting of said binding and said foot covering engaged therein while the user is seated on said chair lift, and comprising, in combination:

a semirigid leash tube having a first end and a second end, said first end adapted to be rotatably attached to said binding;

a leg strap mounted to the second end of said semirigid leash tube, said strap removably attachable around the user's leg at a position accessible to the user while seated on said chair lift;

a snap catch mounted on said leg strap at a preselected position;

a friction grip pad/handle having a snap removably attachable to said snap catch; and, an elastic shock cord having a first and a second end, said shock cord being mounted within said semirigid leash tube and having said first end attached to said rotatable attachment and said second end attached to said friction grip pad/handle remote from said snap whereby under the condition of the user seated on said chair lift the user may disengage said snap from said snap catch, pull on said handle thereby imparting affirmative lift to said binding through said elastic shock cord and place said pad/handle between the user's thigh and the top of said seat to maintain said affirmative lift until at least the user is no longer sitting on said chair lift.

2. The arrangement in claim 1 wherein said elastic shock cord has a preselected elongation.

3. The arrangement in claim 1 further comprising an end plate mounted on said first end of said leash tube whereby the affirmative lift generated by the elastic shock cord is communicated directly to the binding of said snow gliding device.

4. The arrangement in claim 1 wherein said mounting of said leg strap to s aid second end of said leash tube is rotatable whereby sa id arrangement device can be configured for the user being either predominantly left or right handed.

5. The arrangement in claim 1 further comprising a tab at the end of said friction grip pad/handle opposite the end connected to said shock cord thereby easing the removal of said snap from said snap catch.

6. An improved leash arrangement for a snow gliding device having a binding mounted thereon whereby a user wearing foot coverings may engage at least one of said foot coverings into said binding, may connect one end of said leash arrangement to said binding, thereafter said leash arrangement is adapted for use on a chair lift having a seat with a front edge, said leash arrangement providing affirmative hoisting of said binding and said foot covering engaged therein including a ridged high top boot while the user is seated on said chair lift, and comprising, in combination:

a leg strap, said strap removably attachable around the user's leg at a position above said boot and accessible to the user while seated on said chair lift;

a hasp eye mounted on said leg strap;

a snap catch mounted on said leg strap at a preselected position;

a friction grip pad/handle having a snap removably attachable to said snap catch;

an end plate mountable to said snow gliding equipment device; and, an elastic shock cord having a first end and a second end, said first end attached to said end plate and said second end threaded through said hasp eye and attached to said friction grip pad/handle remote from said snap whereby under the condition of the user seated on said chair lift the user may disengage said snap from said snap catch, pull on said handle thereby imparting affirmative lift to said binding through said elastic shock cord and place said pad/handle under the user's thigh to maintain said affirmative lift until at least the user is no longer sitting on said chair lift.

7. The arrangement in claim 6 wherein said elastic shock cord has a preselected elongation and diameter.

8. The arrangement in claim 6 further comprising a tab at the end of said friction grip pad/handle at the end opposite said connection to said shock cord thereby easing the removal of said snap from said snap catch.

9. The arrangement in claim 8 further comprising:

a folded edge guard attached to said friction grip pad/handle opposite said tab;

a plurality of grommets mounted near the folds of said edge guard through which said shock cord may be threaded whereby upon removal of said snap from said snap catch, pulling to extend said shock cord and positioning said pad/handle under the thigh of the user, said edge guard becomes unfolded and positioned under said extended shock cord particularly at the point said shock cord engages the edge of the seat on said chair lift.

10. An improved leash arrangement for a snow gliding device having a binding mounted thereon whereby a user wearing foot coverings such as boots, may engage at least one of said foot coverings into said binding, may connect one end of said leash arrangement to said binding, thereafter said leash arrangement is adapted for use on a chair lift having a seat with a front edge, said leash arrangement providing affirmative hoisting of said binding and said foot covering including boots while the user is seated on said chair lift, said improved leash arrangement is adapted to be accessible at a point above at least one of said boots, and comprising, in combination:

a semirigid leash tube having a first end and a second end;

a leg strap, said strap removably attachable around the user's leg at a position above one of said boots thereby being accessible to the user while seated on said chair lift;

a guide tab mounted on said leg strap in a position to be in communication with said second end of said semirigid leash tube;

a snap catch mounted on said leg strap at a preselected position;

a friction grip pad/handle having a first end and a second end, a snap mounted on said first end removably attachable to said snap catch;

an end plate mountable to said snow gliding device; and, an elastic shock cord having a first and a second end, said shock cord being mounted within said semirigid leash tube and having said first end attached to said end plate and said second end threaded through said guide tab and attached to said second end of said friction grip pad/handle whereby under the condition of the user seated on said chair lift the user may disengage said snap from said snap catch, pull on said handle thereby imparting affirmative lift to said binding through said elastic shock cord and place said pad/handle under the user's thigh to maintain said affirmative lift until at least the user is no longer sitting on said chair lift.

11. The arrangement in claim 10 wherein said elastic shock cord has a preselected elongation and diameter.

12. The arrangement in claim 10 further comprising a tab at the end of said friction grip pad/handle at the end opposite said connection to said shock cord thereby easing the removal of said snap from said snap catch.

* * * * *